US010343831B2

(12) United States Patent
Weyrauch

(10) Patent No.: US 10,343,831 B2
(45) Date of Patent: Jul. 9, 2019

(54) PALLET CONTAINER WITH OVERLAPPING WALL COMPOSITE PARTS

(71) Applicant: MAUSER-WERKE GMBH, Brühl (DE)

(72) Inventor: Detlev Weyrauch, Kreuzau-Untermaubach (DE)

(73) Assignee: MAUSER-WERKE GMBH, Brühl (DE)

( * ) Notice: Subject to any disclaimer, the term of this patent is extended or adjusted under 35 U.S.C. 154(b) by 0 days.

(21) Appl. No.: 15/752,819

(22) PCT Filed: Aug. 16, 2016

(86) PCT No.: PCT/EP2016/001395
§ 371 (c)(1),
(2) Date: Feb. 14, 2018

(87) PCT Pub. No.: WO2017/028949
PCT Pub. Date: Feb. 23, 2017

(65) Prior Publication Data

US 2018/0237199 A1 Aug. 23, 2018

(30) Foreign Application Priority Data

Aug. 17, 2015 (DE) ..... 10 2015 010 492

(51) Int. Cl.
*B65D 77/04* (2006.01)
*A62C 3/06* (2006.01)

(52) U.S. Cl.
CPC ..... *B65D 77/0466* (2013.01); *A62C 3/065* (2013.01); *B65D 2213/00* (2013.01)

(58) Field of Classification Search
CPC ..... A62C 2/065; A62C 2/10; A62C 3/002; A62C 3/0257; A62C 3/00; B65D 77/0466;

(Continued)

(56) References Cited

U.S. PATENT DOCUMENTS 2,819,759 A * 1/1958 Goodloe ..... A41D 31/0027 160/330
4,405,076 A * 9/1983 Lines, Jr. ..... B32B 15/04 220/560.01

(Continued)

FOREIGN PATENT DOCUMENTS

CN 1605550 A 10/2005
CN 1680175 A 10/2005

(Continued)

OTHER PUBLICATIONS

International Search Report issued by the European Patent Office in International Application PCT/EP2016/001395.

(Continued)

*Primary Examiner* — Chun Hoi Cheung
*Assistant Examiner* — Brijesh V. Patel
(74) *Attorney, Agent, or Firm* — Henry M. Feiereisen LLC

(57) ABSTRACT

A pallet container for storing and transporting in particular flammable or easily ignitable liquid filling materials includes a thin-walled rigid internal container made from a thermoplastic plastics material, a tubular lattice frame that as a supporting jacket tightly encloses the plastics-material internal container, and a base pallet on which the plastics-material container bears and to which the tubular lattice frame is fixedly connected. The plastics-material internal container on all sides is enclosed by a fire-protection insulation mat which, while dispensing with a sheet-metal sheathing on all sides, is disposed directly between the tubular lattice frame and the plastics-material internal container. The fire-protection insulation mat is configured in a double-layered manner, and has an internal layer made from a heat-resistant non-woven and an external heat-resistant woven-fabric textile layer.

21 Claims, 6 Drawing Sheets

(58) Field of Classification Search
CPC ..... B65D 90/22; B65D 2213/00; B65D 2213/02; B65D 19/20; B65D 2519/00184; B65D 2519/00218; B65D 2519/0086; B32B 2262/101; B32B 2262/105; B32B 2307/3065; B32B 2439/62
USPC ..... 220/560.01, 62.22, 88.1, 23.91; 169/45, 169/48–49; 428/921
See application file for complete search history.

(56) References Cited

U.S. PATENT DOCUMENTS

| | | | | |
|---|---|---|---|---|
| 5,091,243 | A * | 2/1992 | Tolbert | A47C 31/001 427/393.3 |
| 5,924,589 | A * | 7/1999 | Gordon | A62C 2/065 220/23.87 |
| 5,971,185 | A * | 10/1999 | Schutz | B65D 77/0466 220/1.6 |
| 5,984,126 | A * | 11/1999 | Gordon | A62C 3/002 106/18.11 |
| 7,296,374 | B2 | 11/2007 | Weyrauch et al. | |
| 7,908,980 | B2 | 3/2011 | Schmidt et al. | |
| 8,844,641 | B2 * | 9/2014 | Peltz | A62C 2/065 169/48 |
| 8,863,978 | B2 | 10/2014 | Przytulla et al. | |
| 9,233,777 | B2 | 1/2016 | Weyrauch et al. | |
| 9,394,077 | B2 | 7/2016 | Weyrauch et al. | |
| 9,394,079 | B2 | 7/2016 | Weyrauch et al. | |
| 9,725,213 | B2 | 8/2017 | Weyrauch et al. | |
| 2003/0008119 | A1 * | 1/2003 | Tono | B32B 13/14 428/212 |
| 2006/0011637 | A1 | 1/2006 | Schmidt et al. | |
| 2006/0027582 | A1 * | 2/2006 | Beach | B65D 77/0466 220/495.05 |
| 2007/0199937 | A1 * | 8/2007 | Schutz | A62C 2/065 220/23.91 |
| 2008/0078768 | A1 * | 4/2008 | Apostoluk | B32B 7/02 220/560.01 |
| 2009/0218111 | A1 * | 9/2009 | Shapiro | B32B 7/02 169/45 |
| 2010/0200579 | A1 | 8/2010 | Schmidt et al. | |
| 2013/0175057 | A1 * | 7/2013 | Klancnik | A47C 31/001 169/45 |
| 2015/0069069 | A1 * | 3/2015 | Hariram | B65D 88/14 220/560.01 |

FOREIGN PATENT DOCUMENTS

| | | | | |
|---|---|---|---|---|
| DE | 197 47 690 | A1 | 6/1999 | |
| DE | 101 61 693 | A1 | 7/2003 | |
| EP | 0 879 771 | A1 | 11/1998 | |
| EP | 2 979 991 | A1 | 2/2016 | |
| WO | WO 2015065645 | A1 * | 5/2015 | A62C 3/065 |
| WO | WO 2016012768 | A1 * | 1/2016 | B65D 88/1612 |

OTHER PUBLICATIONS

Chinese Search Report dated Jan. 18, 2019 with respect to counterpart Chinese patent application 2016800485777.
Translation of Chinese Search Report dated Jan. 18, 2019 with respect to counterpart Chinese patent application 2016800485777.

* cited by examiner

PALLET CONTAINER WITH OVERLAPPING WALL COMPOSITE PARTS

CROSS-REFERENCES TO RELATED APPLICATIONS

This application is the U.S. National Stage of International Application No. PCT/EP2016/001395, filed Aug. 16, 2016, which designated the United States and has been published as International Publication No. WO 2017/028949 and which claims the priority of German Patent Application, Serial No. 10 2015 010 492.6, filed Aug. 17, 2015, pursuant to 35 U.S.C. 119(a)-(d).

BACKGROUND OF THE INVENTION

The invention relates to a pallet container for storing and transporting in particular flammable or easily ignitable liquid filling materials, having a thin-walled rigid internal container made from a thermoplastic plastics material, which has an upper filling connector that can be closed off by a screw cap, and optionally a retrieval connector that is disposed in the forward base region and optionally has an attached retrieval fitting, having a tubular lattice frame made from welded-together tubes and that as a supporting jacket tightly encloses the plastics-material internal container, and having a base pallet on which the plastics-material container bears and to which the tubular lattice frame is fixedly connected, wherein the plastics-material internal container within the tubular lattice frame is enclosed by a fire-protection insulation mat. The present invention relates equally to pallet containers without a base-side retrieval fitting, in which the retrieval connector is welded shut, for example, or in which there is no retrieval fitting present or provided at all, respectively.

PRIOR ART

A pallet container of the generic type is known from DE 197 47 690 A1 (Sotra), which pallet container is said to be distinguished by a fire-retardant construction mode and is said to have adequate resistance to fire. To this end, in this pallet container, a thin-walled thermal insulation which is composed of cardboard and aluminum foil is disposed between the plastics-material internal container and the lattice cage. This plate-shaped insulation is said to be employed also between the inner container lower base and the pallet upper base, at least in the case of steel pallets. That side of the insulation layer that faces the plastics-material container is said to be composed of cardboard, and the insulation layer that is assigned to the lattice frame is said to be composed of aluminum, wherein the aluminum layer is said to serve as a heat shield and for dissipating heat, while the cardboard layer by way of an impeded heat transfer is said to cause an insulating effect. The insulation layers made from cardboard and aluminum may additionally be disposed between weather-resistant cover layers made from plastics material, for example from polyethylene. It is disadvantageous in the case of this known embodiment that the base-side retrieval fitting and the entire internal-container upper base with the filling connector and the screw cap remain free and readily accessible, these components thus being exposed to the flames of an adjacent fire in a completely unprotected manner. On account thereof, such a pallet container having an inadequate protection against flames may resist the influences of a fire that acts from the outside for only a very short time.

A similar pallet container having a fire-protection specification is disclosed in DE 101 61 693 A1 (Sch-Pro), in which pallet container a fire-protection jacket that is composed of sheet-metal plates is disposed between the internal container and the lattice frame. Furthermore, an additional fire and heat insulation which also covers the upper and the lower base of the plastics-material internal container is provided between the fire-protection jacket and the internal container. Moreover, for dissipating electric charges, the plastics-material internal container is enclosed by a lattice-type sheathing made from a thin metal wire. The fire and heat insulation is composed of a non-woven glass fiber layer (glass-wool fire-protection material) that is 2 mm thick. Respective clearances for unimpeded access to the upper filling connector with a removable screw cap and to the base-side retrieval fitting are molded in the sheet-metal plates of the fire-protection jacket and in the insulation layer sitting therebelow, that is to say in the cover for the internal-container upper base and of the front pallet container wall. The clearance for the lower retrieval fitting, in order for the latter to be protected, is closable by a sheet-metal lid that is capable of being folded down.

This known pallet container is said to meet the fire-protection guidelines according to US standard NFPA-30, pertaining to the storage of flammable and easily ignitable liquids, that are monitored by Underwriters Laboratories (UL), and in the case of a fire is said to protect the internal bladder from damage or from leakage of the liquid filling material for at least 20 minutes (when supported by a sprinkler installation).

However, it is disadvantageous in the case of this embodiment that the screw cap on the upper filling connector is completely free and unprotected. In the course of a flammability test it has been established that the employed sheet-metal parts of the fire-protection jacket under the influence of external heat become warped and deformed in such a manner that gaps are formed on the abutting edges and between the sheet-metal flap and the front-side sheet metal plate, through which gaps heat and flames may penetrate. The fitting that is composed of plastics material began to burn due to the flames that entered the lower retrieval region, resulting in leakages already after 10 minutes. This known construction of a fire-proofed pallet container moreover requires complex and costly production and assembly that includes the insertion of the additional components of the sheet-metal jacket assembly comprising the upper sheet-metal lid plate. Also, the blow-molded plastics-material internal container by way of the glass-fiber insulation is electrically separated or isolated, respectively, from the lattice frame and from the base pan, such that a lattice-type sheathing made from a thin metal wire is required as electrical connection for dissipating electric charges.

SUMMARY OF THE INVENTION

It is an object of the present invention to refine a pallet container of the generic type having a flame-protection equipment in such a manner that the existing disadvantages of the prior art are overcome, and that an improved and more cost-effective embodiment is made available to the special clientele for this particular product in the market.

This object is achieved by a pallet container for storing and transporting in particular flammable or easily ignitable liquid filling materials, having a thin-walled rigid internal container made from a thermoplastic plastics material, which has an upper filling connector that is closed off by a screw cap, and optionally a retrieval connector that is disposed in the forward base region and optionally has an attached retrieval fitting, having a tubular lattice frame that as a supporting jacket tightly encloses the plastics-material internal container, and having a base pallet on which the plastics-material container bears and to which the tubular lattice frame is fixedly connected, wherein the plastics-material internal container within the tubular lattice frame is laterally enclosed by a fire-protection insulation mat that is composed of a plurality of composite parts, wherein the fire-protection insulation mat is disposed on all sides around the plastics-material internal container, also in front of the lid and base regions of the latter, wherein the mutually adjacent lateral edges of the individual composite parts of the fire-protection insulation mat overlap by a margin in the four vertical rectangular corner regions and/or in the horizontal upper and lower rectangular corner regions along the lateral edges of the plastics-material internal container, wherein in the fire-protection insulation mat in the region about the screw cap for the upper filling connector, and in the region about the attached retrieval fitting, in each case one overlapping cover flap, capable of being opened and of being reclosed, is provided, on account of which the screw lid and the retrieval fitting are completely covered and at all times accessible.

The features in the dependent claims demonstrate further advantageous potential design embodiments of the pallet container according to the invention.

On account of the fire-protection insulation mat being disposed on all sides, that is to say on all six sides, around the cuboid-shaped plastics-material container, also in front of the upper screw-lid region thereof and the base-side filling-material retrieval region, and of the mutually adjacent lateral edges of the individual wall composite parts of the fire-protection insulation mat overlapping by a margin in the four vertical rectangular corner regions and/or in the horizontal upper and lower rectangular corner regions along the lateral edges of the plastics-material internal container, it is guaranteed in a simple yet reliable manner that the heat-sensitive internal container made from a thermoplastic plastics material is protected at each point from any direct influence by flames, wherein in the fire-protection insulation mat in the region about the screw cap for the upper filling connector, and in the region about the attached retrieval fitting, in each case one overlapping cover flap, capable of being opened and of being reclosed, is configured, on account of which the screw lid and the retrieval fitting are completely covered and at all times accessible.

In an advantageous design embodiment of the invention it is provided that the four separate blank panels of the fire-protection insulation mat for the four side walls of the plastics-material internal container, with the respective affixed overlapping strips thereof, are composed of two equally sized and two dissimilarly sized composite parts, wherein the affixed overlapping strips thereof are configured to be of such a size that, while dispensing with a separate insulation-mat composite part for the upper base of the plastics-material internal container, large-area overlapping coverage of the upper base, including the filling opening, takes place. Herein, the two equally-sized blank panels of the fire-protection insulation mat for the two longer side walls of the plastics-material internal container each have one affixed overlapping strip having a width of approx. 100 mm to 450 mm, preferably of approx. 300 mm, the latter being configured in a simple manner as wide overlapping strips for coverage of the upper base of the plastics-material internal container from above by laterally folding onto the upper base.

A further design embodiment according to the invention provides that the two dissimilarly sized blank panels of the fire-protection insulation mat for the two shorter side walls of the plastics-material internal container are equipped with two dissimilarly wide overlapping strips as cover flaps for the upper base of the internal container, wherein the rearward blank panel of the fire-protection insulation mat has an overlapping strip having a width of approx. 300 mm to 550 mm, preferably of approx. 450 mm, and the front-side blank panel of the fire-protection insulation mat has an overlapping strip having a width of approx. 1100 mm to 600 mm, preferably approx. 850 mm.

For protecting the plastics-material internal container in the lower region of the pallet container that is protected from an external influence by flames, the blank panel for the base face of the plastics-material internal container on all four lateral edges each is equipped with one overlapping strip, wherein only the two opposite narrow overlapping strips on the long lateral edges of the internal container have an equal width of approx. 50 mm to 125 mm, preferably of approx. 75 mm. The width of the respective overlapping strips and cover flaps is always measured in a rectangular manner, from the connection line (kinked edge) thereof to the respective planar blank composite part.

The overlapping strips of the blank panels of the fire-protection insulation mat in the case of this invention are awarded high significance. To this end, it is provided in a further design embodiment that the blank panel for the base face of the plastics-material internal container on the shorter rearward lateral edge of the internal container has an overlapping strip having a width of approx. 100 mm to 200 mm, preferably of approx. 150 mm, and on the shorter front-side lateral edge of the internal container has an overlapping strip having a width of approx. 100 mm to 300 mm, preferably of approx. 200 mm, wherein this overlapping strip is centrically interrupted and provided with a clearance for accessing the retrieval fitting. In order for the retrieval fitting to be able to be reliably protected from an undesirable influence of heat, it is provided according to the invention that a rectangular composite part of the fire-protection insulation mat is sewn to the shorter front-side lateral edge of the internal container on the lower side of the blank panel for the base face, in front of the clearance in the overlapping strip, by way of which rectangular composite part the clearance for the retrieval fitting on the lateral edges thereof is coverable in a completely overlapping manner.

In order for various requirements to be met, the fire-protection insulation mat is expediently configured with two layers, to which end said fire-protection insulation mat has an external heat-resistant woven-fabric textile layer and an internal layer made from a heat-resistant fibrous non-woven. Herein, the external woven-fabric textile layer is finished with a metal-powder-containing polyurethane coating which by way of a filling with aluminum powder is configured so as to be electrically conductive (dissipating).

In order for electric charges to be dissipated from the surface of the plastics-material internal container, direct contact between the latter and the outside has to be established, to which end the closable overlapping cover flaps of the fire-protection insulation mat for the upper screw lid and for the lower retrieval fitting are also equipped on the internal side with the electrically conductive woven-fabric textile layer. This also renders handling of the cover flaps more agreeable since there is no direct manual contact with the internal glass-fiber-containing fibrous non-woven of the fire-protection insulation mat.

For fields of application having normal requirements, it has been proven adequate for the thermal protection of the pallet container equipped in this manner against an influence by heat from an igniting source of a fire for the internal non-woven layer and for the external woven-fabric textile layer of the fire-protection insulation mat to be conceived for a unilateral short-term (less than one minute) temperature stress of at least approx. 600° C. Accordingly, it is provided in the same cost-effective manner that the internal non-woven layer and the external woven-fabric textile layer of the fire-protection insulation mat are conceived for a unilateral long-term (more than five minutes) temperature stress of approx. 550° C.

For extraordinary fields of application having extreme requirements in terms of thermal protection, the internal non-woven layer and the external woven-fabric textile layer of the fire-protection insulation mat may be configured for a unilateral short-term (less than one minute) temperature stress of approx. 1600° C., and conceived for a unilateral long-term (more than five minutes) temperature stress of 1200° C.

In a design embodiment of the invention it is expediently provided that the fire-protection insulation mat, including the external woven-fabric textile layer and the internal non-woven layer, has an overall thickness between 5 mm and 8 mm, preferably of 7 mm, wherein the thickness of the external woven-fabric textile layer is only 1 mm to 2 mm, preferably approx. 1.5 mm. The overlapping strips according to the invention, having the double wall thickness of the individual wall composite parts of the fire-protection insulation mat, are located in the four vertical rectangular corner regions of the lattice frame or of the plastics-material internal container, respectively, on the one hand, and in a horizontally encircling manner on the upper and the lower periphery of the lattice frame, on the other hand. Along the lateral edges on the 90° arches of the plastics-material internal container, the spacing from the tubular bars of the lattice frame is larger than in the planar side walls of the plastics-material internal container and of the lattice frame such that sufficient space for the double-layered overlapping strips of the fire-protection insulation mat exists in an advantageous manner in these corner regions between the plastics-material internal container and the external lattice frame.

According to a further embodiment according to the invention, the front and/or the rear side wall part of the fire-protection insulation mat toward the top is configured so as to be extended in length in such a manner that said side wall part in the manner of a cover flap is configured to be placeable on top of the screw lid, or to be placeable in the direction toward the opposite side wall part, so as to be on top thereof, on account of which an extensive overlap between the upper insulation-mat parts is achieved and the screw lid is completely and securely covered. The front and the rear cover flap each are routed through under the two transverse supports of the tubular lattice frame, and are fixed by said transverse supports on the upper base of the plastics-material internal container. The front cover flap is advantageously embodied to be somewhat longer than the rear cover flap. The rear and somewhat shorter cover flap almost reaches up to the upper filling connector. The front cover flap which covers the screw lid that is screwed onto the filling connector approximately reaches up the rear transverse support. In order for the fire-protection insulation mat to be closed, the end, or the front edge, respectively, of the front and somewhat longer cover flap is pushed under the front edge of the rear cover flap, approximately up to the rear transverse support, such that the front cover flap is covered by a margin by the rear cover flap, or such that the two cover flaps are mutually overlapping by a considerable margin.

As reliable protection of the lower retrieval fitting a separate rectangular blank panel is provided for completely covering or superimposing, respectively, the base-proximate clearance for access to the retrieval fitting in the front side-wall blank panel of the fire-protection insulation mat, said separate rectangular blank panel being larger than the rectangular clearance for the retrieval fitting, wherein the separate blank panel of the fire-protection insulation mat by way of the lower periphery thereof on the base side is sewn to the fire-protection insulation mat below the plastics-material internal container such that said blank panel of the fire-protection insulation mat as a cover flap is configured so as to be foldable from bottom to top in front of the clearance and fixedly clampable behind a horizontal lattice bar. On account thereof, it is reliably prevented in the case of a fire that flames may enter the free space (doghouse) around the retrieval fitting, which flames would melt and burn the retrieval fitting that is composed of a plastics material and protrudes into the free space, and the handle thereof, within a short time, as has been usual in the case of known pallet containers of this construction mode.

By way of the features of the present invention that have been demonstrated above it is possible for a pallet container of the generic type having a flame-protection device to be configured in such a manner that said pallet container is producible in a simpler and more cost-effective manner, is composed of fewer components, and in terms of weight is configured so as to be lighter, wherein the tightness of the filled plastics-material internal container is guaranteed for a period of an influence by flames of at least approx. 25 minutes.

Further advantages of the present achievement according to the invention lie in particular in the following: the internal-side glass-fiber-material-containing fibrous non-woven layer is usually non-conducting. In the case of the present construction, the antistatic/conductive coated woven fabric of the external layer is also applied on the inside in the region of the filling connector and the retrieval fitting and is thus in direct contact with the plastics-material internal container. On account thereof, a ground connection of the blow-molded part that is capable of dissipation by way of the conductive internal layer to the external woven-fabric side and thus to the lattice basket, or to the base pan, respectively, is guaranteed.

BRIEF DESCRIPTION OF THE DRAWING

The invention will be explained and described in more detail hereunder by means of an exemplary embodiment which is illustrated schematically in the drawings in which.

DETAILED DESCRIPTION OF PREFERRED EMBODIMENTS

Figure 1:
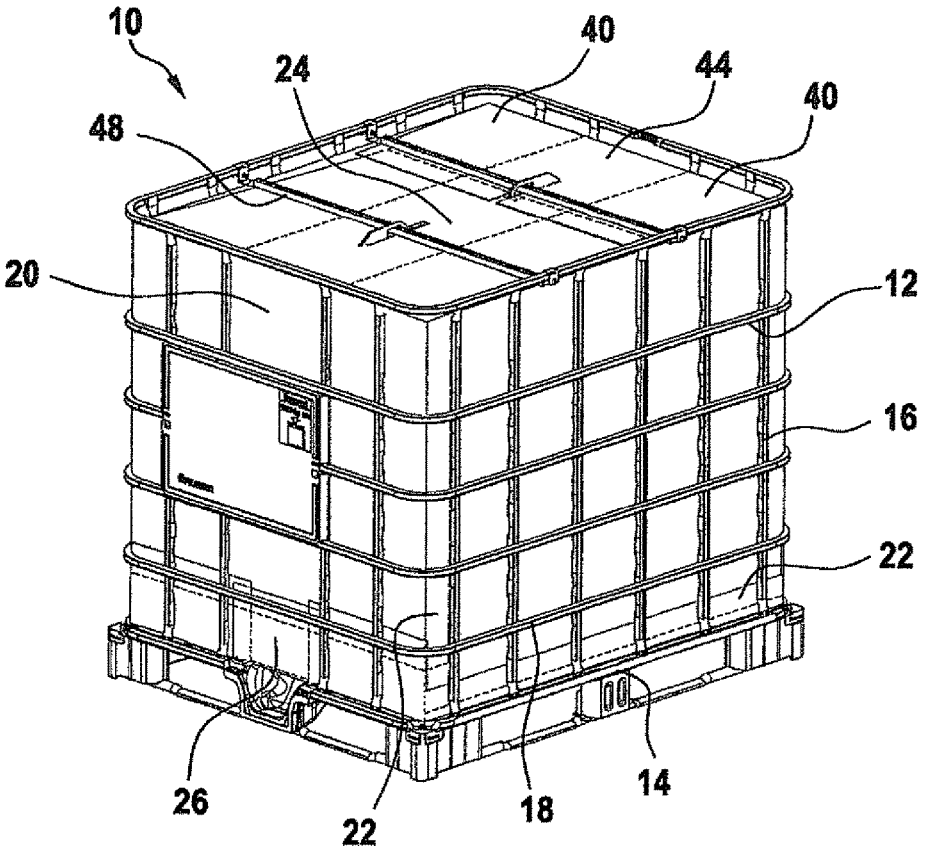
FIG. 1 shows a perspective view of a pallet container according to the invention, having a fire-protection insulation mat.

A pallet container (UL-IBC) according to the invention, having a filling volume of 1000 l, having a thin-walled rigid internal container (not visible) made from a thermoplastic plastics material for storing and transporting in particular hazardous flammable liquids, having a tubular lattice frame 12 that as a supporting jacket tightly encloses the plastics-material container, and having a base pallet 14 on which the plastics-material container bears and to which the supporting jacket is fixedly connected is referred to with the reference sign 10 in FIG. 1. The tubular lattice frame 12 (external container) of the pallet container 10 is composed of welded-together vertical and horizontal tubes 16, 18. In order for a closed external container to be obtained, the encircling horizontal tubes 18 each are welded to one another. The base pallet 14 may be configured as a steel pallet, as a composite pallet (tubular steel frame with plastics-material feet), or as a special heat-resistant timber pallet. In the case of this pallet container 10, while dispensing with a sheet-metal sheathing on all sides, a fire-protection insulation mat 20 as a complete sheathing is disposed directly between the tubular lattice frame 12 and the plastics-material internal container. The fire-protection insulation mat 20 is composed of a plurality of, preferably five, dissimilarly sized composite parts that each mutually overlap by a margin in the corner regions of the plastics-material internal container and of the tubular lattice frame 12. This overlap or blanketing, respectively, of the mutually adjacent blank panels of the fire-protection insulation mat 20 should be at least approx. 20 mm to 120 mm, preferably approx. 75 mm. The overlapping strips 22 that are formed in this manner at the upper and the lower periphery of the tubular lattice frame 12, or of the plastics-material internal container, respectively, run in the horizontal direction, and in the rectangular corner regions of the mutually adjacent side walls of the tubular lattice frame 12 run in the vertical direction.

The screw cap that is screwed onto the filling connector that is disposed so as to be centric in the upper base of the internal container is covered by an upper large cover flap 24, and the lower retrieval fitting is covered by a smaller cover flap 26 such that the plastics-material internal container is completely sheathed and wrapped without a gap, no flames and any direct influence of heat (hot air) being able to get to said plastics-material internal container in the case of a fire. The composite parts of the fire-protection insulation mat 20 are not sewn together because this would be too labor-intensive and too cost-intensive. Said composite parts are simply placed into the tubular lattice frame 12, being self-jamming in the overlapping strip 22, until the internal container is inserted and all composite parts are fixedly jammed between the internal container and the tubular lattice frame. The only exception lies in the small rectangular composite part for covering the retrieval fitting, said rectangular composite part being fixedly sewn to the base composite part 32. This small cover flap 26, for fixing thereof in the closed state, is only pushed behind the first transversely running tubular lattice bar (horizontal bar) above the retrieval fitting and is fixedly jammed on account thereof. When accessing the lower retrieval fitting, the cover flap 26 may simply be manually pulled out from behind the transversely running tubular bar, and for closing may be push-fitted back therebehind. The long upper cover flap 24 for covering the screw cap on the upper filling connector, in the closure case, is push-fitted under the front edge of the opposite overlapping strip 44 that is folded back from the rear-wall composite part 42 onto the top of the plastics-material internal container up to a transverse support 48 that runs transversely thereabove, and is fixed on account thereof. For opening, or for exposing the screw cap, respectively, this cover flap 24 is pulled out from below the overlapping strip 44, and after filling of the internal container and screwing the screw cap back on, is again pushed under the opposite overlapping strip 44 and fixedly jammed.

Figure 2:
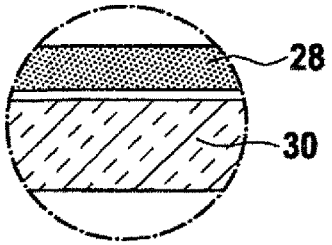
FIG. 2 shows a cross-sectional partial view of the construction of a double-layered fire-protection insulation mat.

FIG. 2, in a circular fragment, shows the structural concept of the fire-protection insulation mat 20 which is presently configured in a double-layered manner, having an external woven-fabric textile layer 28 and an internal fibrous non-woven layer 30: The external woven-fabric textile layer 28 is provided with a polyurethane coating. The coating is enriched using a metal powder. The metal powder is preferably composed of aluminum pigments. This surface coating made from polyurethane having aluminum powder is applied for high heat reflection, on the one hand. This polyurethane coating, apart from water-repellant properties, also has anti-static properties (30–50 GΩ–100 V), on account of which the UL-IBC according to the invention is suitable for EX applications and may be certified according to the EX classification. The employed woven-fabric textile material of the external woven-fabric textile layer 28 is produced from high-quality and in part texturized and twisted yarns, and is outstandingly suitable for thermal and acoustic insulation with high temperature resistance. Said woven-fabric textile material is commercially freely available in a keenly priced embodiment for medium requirements with short-term temperature stresses of approx. 600° C. and long-term temperature stresses of approx. 550° C. under the "isoTEX" label and is usually used as a woven heat-protection fabric, for example for welding curtains and fire-extinguishing blankets.

For maximum temperature stresses with a short-term stress of approx. 1660° C. and a long-term temperature influence of approx. 1200° C., a particular woven-fabric textile material is commercially freely available and sourceable. This highly temperature-resistant protective woven "silTEX" fabric has been specially developed for the long-term and durable employment in the high-temperature sector and is not flammable. Said woven "silTEX" fabric is particularly suitable as heat protection and insulation woven fabric for maximum temperature stresses and offers outstanding protection even against liquid metal spillings and red-hot scum. In the case of the internal fibrous non-woven layer 30, the non-woven used is composed of mechanically needle-bonded silica-glass fibers, having excellent insulation properties and a high temperature resistance. The non-woven mats are very flexible and are employed on an industrial scale for damping or insulating; for these purposes, said non-woven mats are commercially available under the "isoFLEX" label.

Figure 3:
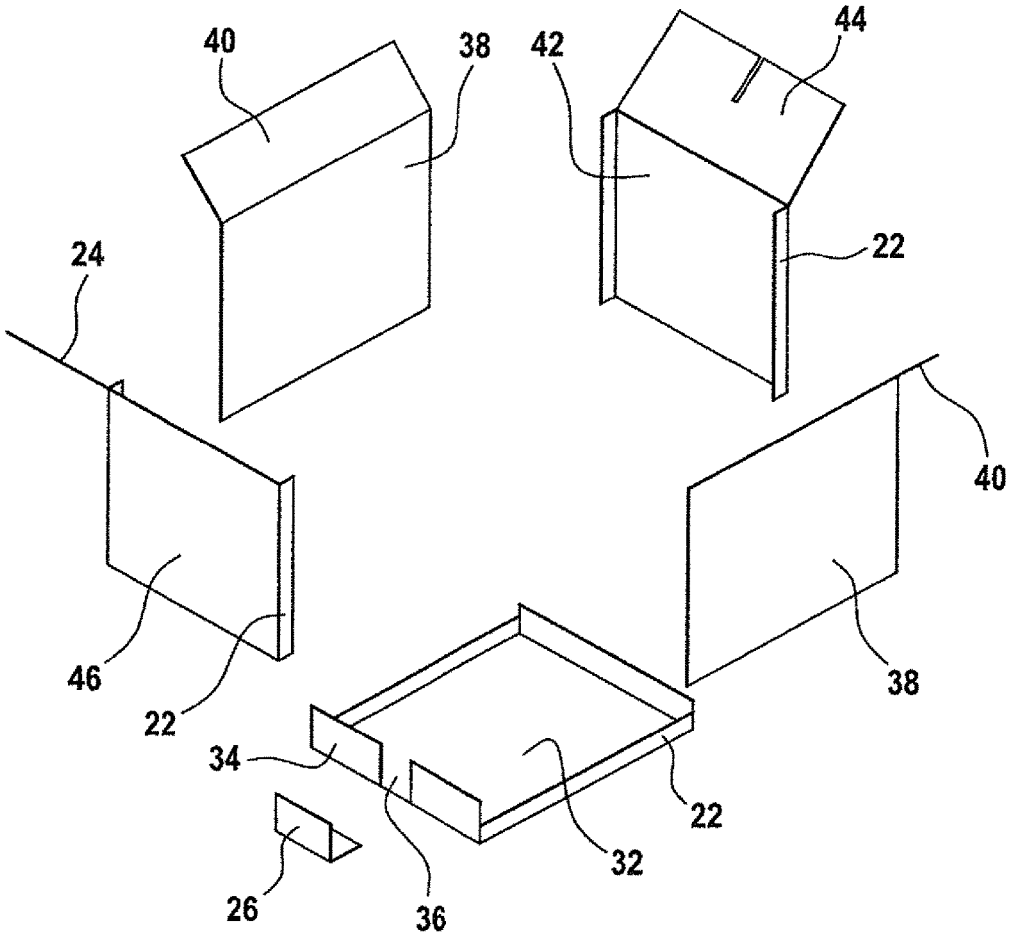
FIG. 3 shows a perspective view of the individual wall parts having external overlap regions, for the fire-protection insulation mat.

All six individual wall composite parts having the external overlapping strips 22 of the fire-protection insulation mat are illustrated in FIG. 3. The base part is a large base-wall part 32 having dimensions of 1000 mm×1170 mm, and having laterally encircling folded-up overlapping strips 22 on all four lateral edges, wherein the front and somewhat higher overlapping strip 34 has a clearance 36 for access to the retrieval fitting. The small rectangular cover flap 26 which is fixedly sewn on below the base-wall part 32 is provided for covering this clearance 36 in an overlapping manner, and for protecting the retrieval fitting. The fire-protection insulation mat furthermore comprises two mutually opposite composite parts 38, each having large overlapping strips 40 at the upper periphery, for the longer side walls. A composite part 42 having a large slightly trapezoidal overlapping strip 44 at the upper periphery is provided for the shorter side walls, that is to say for the rearward rear wall, and a rectangular composite part 46 having a very large slightly trapezoidal overlapping strip at the upper periphery is provided for the front wall, wherein this very large overlapping strip will be referred to as the upper large cover flap 24, since the latter is folded over the screw cap of the upper filling connector.

Figure 4:
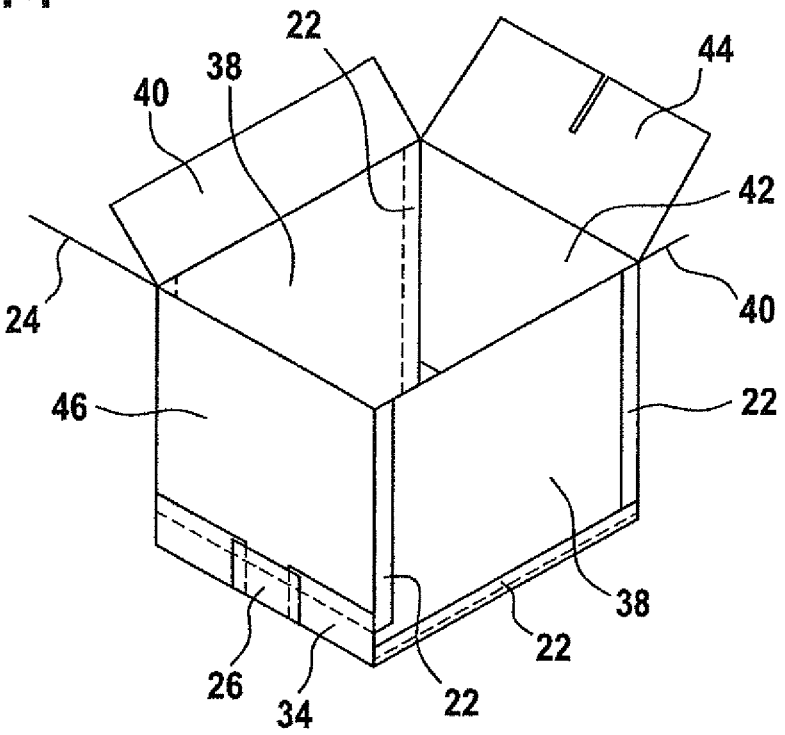
FIG. 4 shows a perspective view of the individual wall parts in an assembled cuboid shape in the case of an opened upper base.

For a better understanding, FIG. 4 shows a perspective view of how the individual composite parts of the fire-protection insulation mat 20 in the assembled cuboid shape overlap with the overlapping strips 22 in the corner regions when the upper base is open, or with the upper overlapping strips 40, 44 unfolded and the upper cover flap 24 unfolded, respectively (without the enclosing tubular lattice frame of the pallet container).

Figure 5:
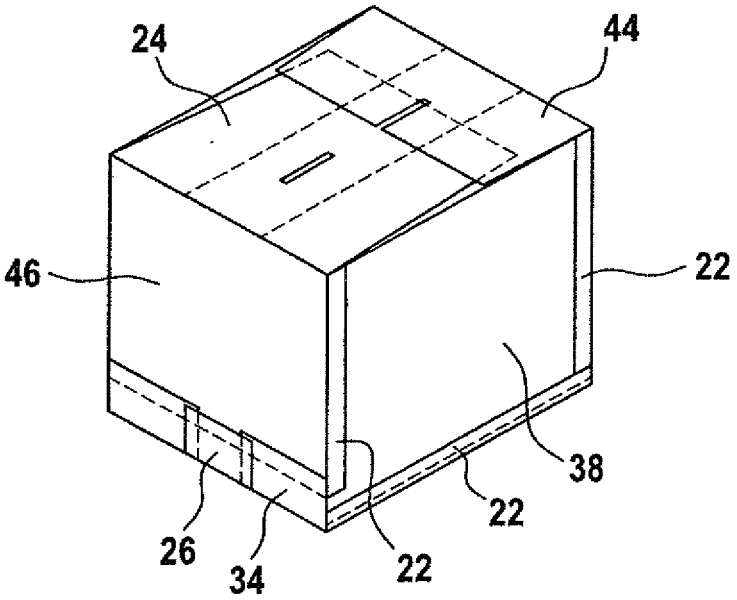
FIG. 5 shows a perspective view of the individual wall parts in an assembled cuboid shape in the case of a closed upper base.

The cuboid shape of the assembled composite parts of the fire-protection insulation mat 20 having the closed upper base or having the folded-in upper overlapping strip 40, 44 and the folded-in upper cover flap 24 can be seen in FIG. 5. Herein, the front side of the upper cover flap 24 is covered by a margin of the magnitude of approx. 50 mm to 100 mm by the wide upper overlapping strip 44.

The assembly of the individual composite parts of the fire-protection insulation mat 20 is not performed in free space, of course, but in steps into the tubular lattice frame 12 of the pallet container. Herein, the base wall part 32 is initially placed symmetrically onto the surface of the base pallet 14, and the small cover flap 26 for the retrieval fitting is pulled out between the two central vertical bars. The somewhat longer overlapping strips 34 of the front wall and of the rear wall are placed upright from the inside against the tubular bars of the lattice frame, thereafter the two narrower overlapping strips 22 of the longer lateral edges are likewise placed upright from inside against the tubular bars. From among the four side walls, the front wall part 46 of the fire-protection insulation mat 20 is then hooked into the lattice frame 12, wherein the lateral overlapping strips 22 in the vertical corner regions are bent from inside against the neighboring side walls of the tubular lattice frame in such a manner that the outermost vertical bar of the neighboring side wall in each case is covered by at least 10 mm. The upper large cover flap 24 at the upper periphery of the front wall 46 initially remains freely folded outward. Thereafter, the opposite composite part of the fire-protection insulation mat for the shorter rear wall of the plastics-material internal container is inserted into the tubular lattice frame 12, wherein the lateral overlapping strips 22 in the vertical corner regions are bent from the inside against the neighboring side walls of the tubular lattice frame in a likewise manner such that the outermost vertical bar of the neighboring side wall is in each case covered by at least 10 mm. For completion, the two opposite longer side walls are now inserted and pressed from the inside against the tubular lattice frame and on the lateral edges in the vertical corner regions are pressed from the inside against the overlapping strips 22 of the front wall 46 and of the rear wall 42. Finally, the plastics-material internal container is pushed in, and the upper wide overlapping strips 40, 44, and the upper large cover flap 24, are folded in onto the upper base of the internal container.

Two elevated eyelets which are plug-fitted through slots, specifically provided therefor, in the upper overlapping strip 44 and in the cover flap 24 of the fire-protection insulation mat 20 such that said eyelets project upward (see FIG. 1) are configured on the upper base of the internal container, so as to be lateral next to the filling connector, or to the screwed-on screw cap. Two transversely running metal bars, the so-called transverse supports 48, are push-fitted through these elevated eyelets and are screwed to the upper external periphery of the tubular lattice frame 12. These transverse supports 48 serve for reliably fixing and holding down the mutually overlapping four component parts of the fire-protection insulation mat 20 (overlapping strips 40, 44, and large cover flap 24).

Figure 6:
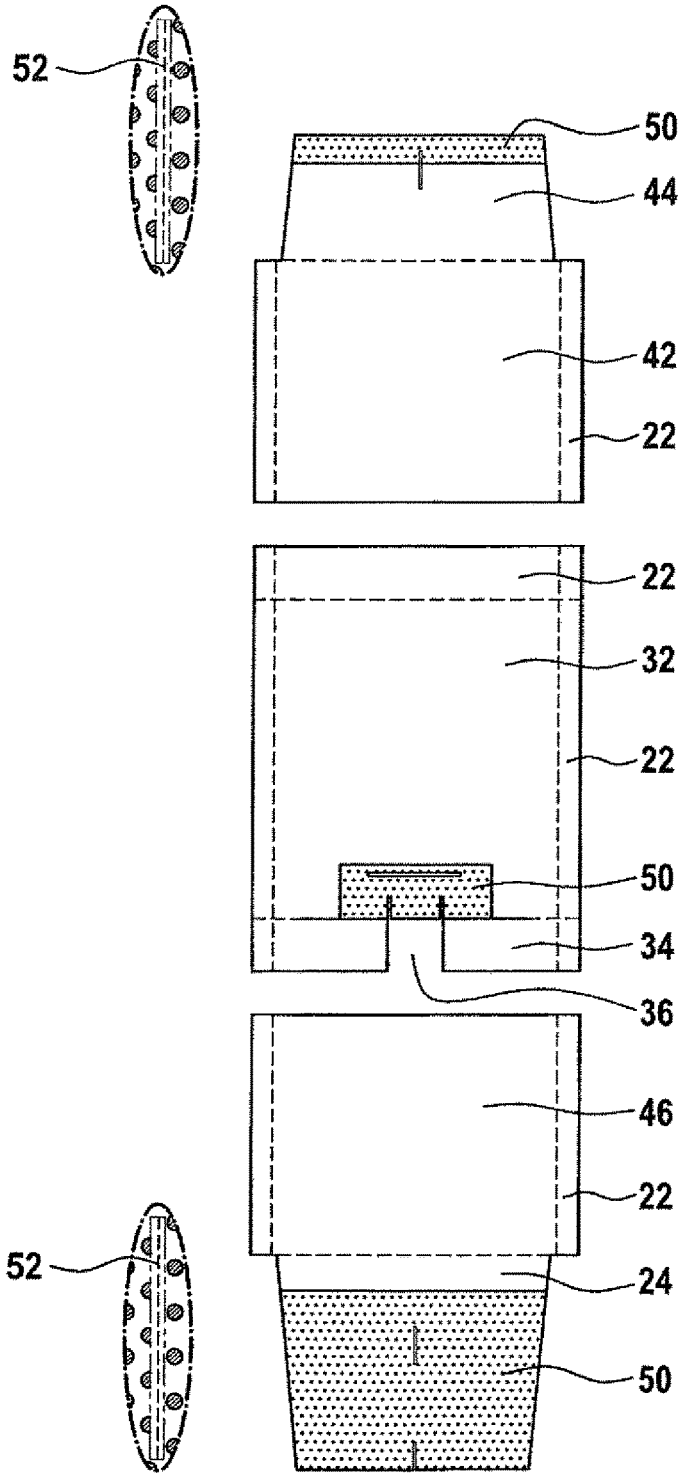
FIG. 6 shows a plan view of the individual blank panels, having external overlap regions for the lower base, the upper base, and the front and the rear wall.
Figure 7:
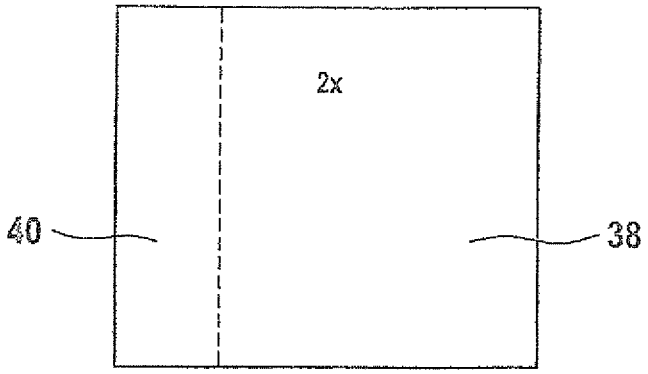
FIG. 7 shows a plan view of the individual blank panels, having external overlap regions for the two opposite side walls.

The individual blank panels, having external overlapping strips for the lower base, the front and the rear wall, and for the two opposite side walls, are once again illustrated with more details from the internal side in FIG. 6 and FIG. 7. In this way, a region 50 in the shorter upper cover flap, or in the overlapping strip 44, respectively, at the upper periphery is embodied in a gray dotted manner; a gray dotted region 50 of this type is likewise embodied at the lower periphery of the base insulation mat 32, directly in front of the clearance 36 in the overlapping strip 34, and almost the entire lower side of the large cover flap 24 is drawn as a gray dotted region 50. These gray dotted regions 50 symbolize that the internal side (or the lower side, respectively) of the fire-protection insulation mat here too is covered with the silver-coloured external woven-fabric textile layer (28).

Figure 8:
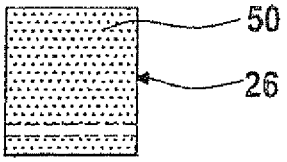
FIG. 8 shows a plan view of the cover flap for the lower retrieval fitting.

The small cover flap 26, illustrated in FIG. 8, as a gray dotted region 50 is covered in a fully planar manner by the electrically conductive woven-fabric textile layer. The fastening seam by means of which the cover flap 26 is sewn to the base component part 32 can still be seen at the lower periphery. These gray dotted sections during handling of the pallet container of the generic type are often manually gripped by the operators, for example when opening and closing the upper cover flap 24 in order to unscrew the screw cap when filling the pallet container, and when opening and closing the lower cover flap 26 in order to operate the retrieval fitting when retrieving filling material from the pallet container. The silver-coloured woven-fabric textile layer is far more agreeable to grip, in particular without protective gloves, than the glass-fiber non-woven on the internal side of the fire-protection insulation mat. Furthermore, these internal-side regions 50 are very important for direct contact between the plastics-material internal container and the electrically conductive woven-fabric textile layer, in order for an EX classification of the pallet container to be obtained, as said internal-side regions 50 guarantee the reliable dissipation of electric charges from the surface of the plastics-material internal container, and prevent undesirable dangerous sparking.

Two stitched slots 52 through which the eyelets for the transverse supports are push-fitted in the completely assembled pallet container are illustrated—drawn in an oval manner on the left—in the shorter upper cover flap, or in the overlapping strip 44 (FIG. 6), respectively, and in the large cover flap 24.

It becomes clear from the previous description and from the illustrations of the figures that in each case a rather large region is overlapped in the corner regions on the upper base of the internal container, and thus a double wall thickness of the fire-protection insulation mat exists therein. To this end, the overlapping strips 40, 44, 24 of the fire-protection insulation mat on the upper base of the plastics-material internal container are made considerably wider in order for in particular the corner regions of the internal container to be even better protected from above. This is very expedient, on the one hand, because an air bubble is always located at the top in the internal container, even in the case of complete filling with liquid, and because the liquid cannot perform any dissipation of heat from the surface wall of the internal container. On the other hand, because the corner feet that are composed of a plastics material may start to burn when stacked, and may represent an additional source of a fire, or an additional heat source, respectively.

Figure 9:
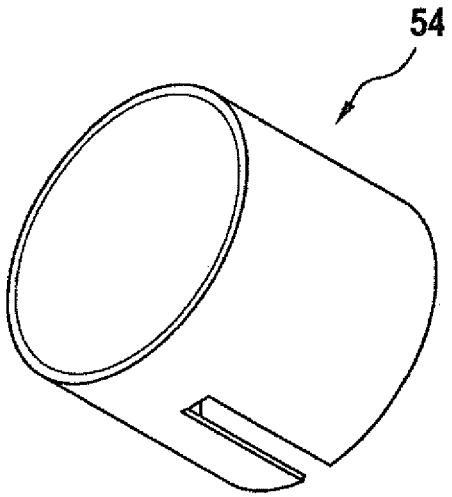
FIG. 9 shows a perspective external view of a separate protective hood for the lower retrieval fitting.
Figure 10:
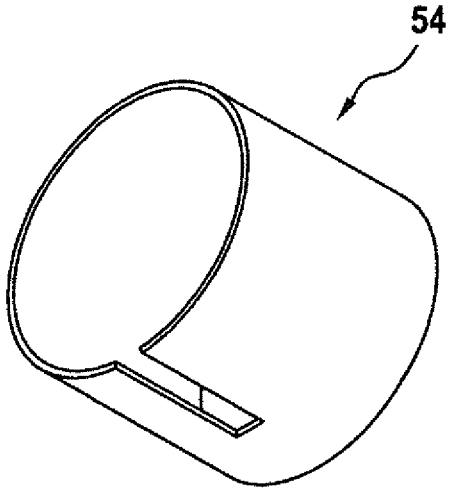
FIG. 10 shows a perspective internal view from below of the separate protective hood for the lower retrieval fitting.

It is advantageously provided for the particular protection of the retrieval fitting that projects from the lower retrieval connector that within the recess in the lower front wall of the plastics-material internal container (doghouse) a bowl-shaped heat-protection cover, as a protective hood 54, made from the same material as the fire-protection insulation mat is placed around or push-fitted over the retrieval fitting, respectively, behind the lower small cover flap 26 such that said protective cover 54 almost fills the free space within the recess around the attached retrieval fitting, behind the cover flap 26, thus preventing hot air from reaching the retrieval fitting which is also composed of a plastics material. To this end, the protective cover may also be designed in the manner of a cushion or so as to be voluminous. The separate additional heat-protection cover hood 54 is illustrated in two different perspective views in FIG. 9 and FIG. 10. This protective cover 54 is used in particular in the case of long retrieval connectors or long retrieval-fitting housings, such as in the case of a Camlock connector, for example.

CONCLUSION

A "flame-tight" insulation of the outflow region is fundamentally very important. This has been demonstrated by a 15-minute flammability test using a known UL IBC of the prior art as mentioned at the outset, in which the fire-protection insulation did not remain tight because the protective sheet-metal parts had buckled in a non-uniform manner. Apart from the flame tightness, it has also to be ensured that the combustion air which is approx. 900° C. hot cannot penetrate the outflow region (doghouse). This was able to be implemented without any leakage in the case of a 45-minute flammability test using a pallet container according to the invention, having a good overlap of the insulation-mat parts. The individual woven-fabric parts remain so as to be tightly adjacent, do not deform, so that even the handle of the retrieval fitting remained unaffected. Increased safety in terms of the retrieval fitting and of the handle may be achieved in particular cases by using a separate protective hood.

What is claimed is:

1. A pallet container for storing and transporting a liquid filling material, said pallet container comprising:

a thin-walled rigid internal container made from a thermoplastic plastics material, said internal container including an upper filling connector that is closed off by a screw cap;

a tubular lattice frame forming a supporting jacket to tightly enclose the internal container;

a base pallet for support of the internal container, said tubular lattice frame being fixedly connected to the base pallet; and a fire-protection insulation mat composed of individual composite parts and laterally enclosing the internal container within the tubular lattice frame, said fire-protection insulation mat being configured such that mutually adjacent lateral edges of the individual composite parts of the fire-protection insulation mat overlap in four vertical rectangular corner regions and in horizontal upper and lower rectangular corner regions along lateral edges of the internal container, said fire-protection insulation mat including in a first region about the screw cap an overlapping first cover flap, to completely cover the first region, when closed, and to enable the screw cap to be accessible at all times, when opened.

2. The pallet container of claim 1 for storing and transporting a flammable or easily ignitable liquid filling material.

3. The pallet container of claim 1, wherein the fire-protection insulation mat includes four separate blank panels configured for four side walls of the internal container and including affixed overlapping strips, respectively, each said blank panel being composed of two equally sized and two dissimilarly sized composite parts, said overlapping strips being sized sufficient to provide a large-area overlapping coverage of an upper base, including a filling opening of the upper filling connector.

4. The pallet container of claim 3, wherein two of the four separate blank panels are of equal size and provided for two longer ones of the side walls, said overlapping strips of the two blank panels having each a width of approx. 100 mm to 450 mm to define wide overlapping strips which for coverage are laterally foldable onto the upper base.

5. The pallet container of claim 3, wherein two of the four separate blank panels are dissimilar in size and provided for two shorter ones of the side walls, said overlapping strips of the two blank panels having different widths to define for the upper base a cover flap comprised of the first cover flap and a third cover flap, with the overlapping strip of one of the two dissimilar blank panels, provided for a rearward one of the shorter side walls, being defined by a width of approx. 300 mm to 550 mm and with the overlapping strip of the other one of the two dissimilar blank panels, provided for a front-side one of the shorter side walls, being defined by a width of approx. 1100 mm to 600 mm.

6. The pallet container of claim 3, wherein at least one of the blank panels of the fire-protection insulation mat for a front or rear one of the side walls of the internal container is extended upwards to allow placement thereof in a manner of a cover flap on top of the screw cap or in a direction toward the opposite one of the blank panels so as to be on top thereof, thereby completely and securely covering the screw cap.

7. The pallet container of claim 1, wherein the fire-protection insulation mat includes a blank panel provided for a base face of the internal container and having four lateral edges, each said lateral edge including an overlapping strip, with two opposite narrow ones of the overlapping strips on longer ones of the lateral edges of the internal container having an equal width of approx. 50 mm to 125 mm.

8. The pallet container of claim 7, further comprising a retrieval connector disposed in a base region of the internal container and having an attached retrieval fitting, wherein the blank panel for the base face of the internal container on a shorter rearward one of the lateral edges of the internal container has an overlapping strip defined by a width of approx. 100 mm to 200 mm and on a shorter front-side lateral edge of the internal container has an overlapping strip defined by a width of approx. 100 mm to 300 mm with the overlapping strip of the blank panel on the shorter front-side lateral edge of the internal container being centrically interrupted and provided with a clearance for accessing the retrieval fitting.

9. The pallet container of claim 8, wherein a rectangular one of the individual composite parts of the fire-protection insulation mat is sewn to the shorter front-side lateral edge of the internal container on a lower side of the blank panel for the base face, in front of the clearance in the overlapping strip, said rectangular composite part being configured to cover the clearance for the retrieval fitting on the lateral edges thereof in a completely overlapping manner.

10. The pallet container of claim 1, wherein the fire-protection insulation mat is configured with two layers, with one of the two layers embodying an external heat-resistant woven-fabric textile layer and the other one of the two layers embodying an internal layer being made from a heat-resistant fibrous non-woven.

11. The pallet container of claim 10, wherein the external heat-resistant woven-fabric textile layer includes a metal-powder-containing polyurethane coating filled with aluminum powder so as to be electrically conductive (dissipating).

12. The pallet container of claim 10, wherein the internal layer and the external heat-resistant woven-fabric textile layer of the fire-protection insulation mat are configured for a unilateral short-term temperature stress of at least approx. 600° C.

13. The pallet container of claim 10, wherein the internal layer and the external heat-resistant woven-fabric textile layer of the fire-protection insulation mat are configured for a unilateral long-term temperature stress of approx. 550° C.

14. The pallet container of claim 10, wherein the internal layer and the external heat-resistant woven-fabric textile layer of the fire-protection insulation mat are configured for a unilateral short-term temperature stress of approx. 1600° C.

15. The pallet container of claim 10, wherein the internal layer and the external heat-resistant woven-fabric textile layer of the fire-protection insulation mat are configured for a unilateral long-term temperature stress of 1200° C.

16. The pallet container of claim 10, wherein the fire-protection insulation mat has an overall thickness between 5 mm and 8 mm with a thickness of the external heat-resistant woven-fabric textile layer ranging from 1 mm to 2 mm.

17. The pallet container of claim 1, further comprising a retrieval connector disposed in a base region of the internal container and having an attached retrieval fitting, said fire-protection insulation mat including in a second region about the retrieval fitting an overlapping second cover flap to completely cover the second region, when closed, and to enable the retrieval fitting to be accessible at all times, when opened.

18. The pallet container of claim 17, wherein the first cover flap of the fire-protection insulation mat for the screw cap and the second cover flap of the fire-protection insulation mat for the retrieval fitting have an internal side provided with an electrically conductive woven-fabric textile layer.

19. The pallet container of claim 17, wherein the fire-protection insulation mat includes a separate rectangular blank panel configured to form the second cover flap and sized to completely cover a base-side rectangular clearance in a front side-wall blank panel of the fire-protection insulation mat for protecting the retrieval fitting, said separate rectangular blank panel being sized larger than the base-side rectangular clearance and having a lower periphery which on the base side is sewn to the fire-protection insulation mat below the internal container such that the blank panel of the fire-protection insulation mat is foldable from bottom to top in front of the base-side rectangular clearance and fixedly clampable behind a horizontal lattice bar of the internal container.

20. The pallet container of claim 17, wherein the internal container has a lower front wall formed with a recess below the second cover flap, and further comprising a bowl-shaped thermal-protection hood made from a same material as the fire-protection insulation mat and push-fitted as an additional separate protection cap over the retrieval fitting, when the the second cover flap is in a closed state.

21. The pallet container of claim 17, wherein the second flap is sized smaller than the first cover flap.

* * * * *